US006962335B2

(12) United States Patent
Liao

(10) Patent No.: US 6,962,335 B2
(45) Date of Patent: Nov. 8, 2005

(54) PLAYING FIGURE OF TABLE SOCCER

(76) Inventor: Grace Liao, 9F, No. 196, Ming-Sheng Rd., Hsinchu City (TW)

( * ) Notice: Subject to any disclaimer, the term of this patent is extended or adjusted under 35 U.S.C. 154(b) by 56 days.

(21) Appl. No.: 10/788,952

(22) Filed: Feb. 27, 2004

(65) Prior Publication Data

US 2005/0189713 A1 Sep. 1, 2005

(51) Int. Cl.[7] ..... A63F 7/07
(52) U.S. Cl. ..... 273/108.52; 273/108.54
(58) Field of Search ..... 273/108–108.57, 273/129 R–129 W

(56) References Cited

U.S. PATENT DOCUMENTS 3,574,350 A * 4/1971 May ..... 273/108.52
3,627,322 A * 12/1971 Leonhart ..... 273/108.52
3,926,432 A * 12/1975 Furr et al. ..... 273/108.52
3,977,122 A * 8/1976 Meyer et al. ..... 446/268
4,025,073 A * 5/1977 Furr et al. ..... 273/108.52
4,824,414 A * 4/1989 Goldblatt ..... 446/226
5,333,864 A * 8/1994 McCloud ..... 273/108.52
5,605,328 A * 2/1997 Rudell et al. ..... 273/108.1
6,105,961 A * 8/2000 Price ..... 273/108.52
6,357,744 B1 * 3/2002 Ho ..... 273/108.52
6,663,108 B2 * 12/2003 Makhoul ..... 273/317.3

* cited by examiner

*Primary Examiner*—Sebastiano Passaniti

(57) ABSTRACT

A table soccer playing figure includes a figure body that is mounted to an axially movable and rotatable actuating rod of a table soccer to take a vertical posture and a counterweight made in the form of a jacket for removably fitting over the figure body to change the figure from the vertical posture to a horizontal posture. The removable counterweight allows players of the table soccer to selectively play with figures of either vertical posture or horizontal posture by dismounting/mounting the jacket from/to the figure body.

5 Claims, 5 Drawing Sheets

PLAYING FIGURE OF TABLE SOCCER

BACKGROUND OF THE INVENTION

1. Field of the Invention

The present invention relates generally to the field of table soccer, which is also known as foosball or babyfoot, and in particular to a playing figure of the table soccer having a selectively fitted counterweight for different postures of the playing figure.

2. The Related Art

Table soccer has been a widely popular game for a long time. The table soccer is played on a table on which a number of parallel arranged actuating rods are mounted. The rods are both axially movable and rotatable. Playing figures or "men" are mounted on the rods and are driven by players with the rods to hit a ball on the table surface. The playing figures are usually of two postures, one for vertical and the other for horizontal. In the former, the playing figure that has a body portion and a leg portion is oriented in a vertical direction with the leg portion located below the body portion and the actuating rod and close to the table surface for "blocking" the movement of the ball, while in the later, the playing figure is horizontally oriented whereby the body portion and the leg portion are substantially on the same horizontal plane as the actuating rod, leaving a large gap between the figure and the table surface for the pass of the ball. The horizontal posture allows a player to quick respond but leaves the goal zone un-protected by the figure.

Improvements on the playing figure to enhance the controllability of the ball by the players are known. However, teaching regarding selective change of figure posture was not available in the prior art.

What is thus desired to provide by the present invention is a table soccer playing figure that allows for ready and selective change of figure posture to suit different requirements for professional players and new hands.

SUMMARY OF THE INVENTION

The present invention provides a table soccer figure that is selectively fitted with a counterweight whereby the figure can be selectively oriented in different postures.

More specifically, the present invention provides a table soccer playing figure comprising a figure body that is mounted to an axially movable and rotatable actuating rod of a table soccer to take a vertical posture and a counterweight made in the form of a jacket for removably fitting over the figure body to change the figure from the vertical posture to a horizontal posture. The removable counterweight allows players of the table soccer to selectively play with figures of either vertical posture or horizontal posture by dismounting/mounting the jacket from/to the figure body.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 4:
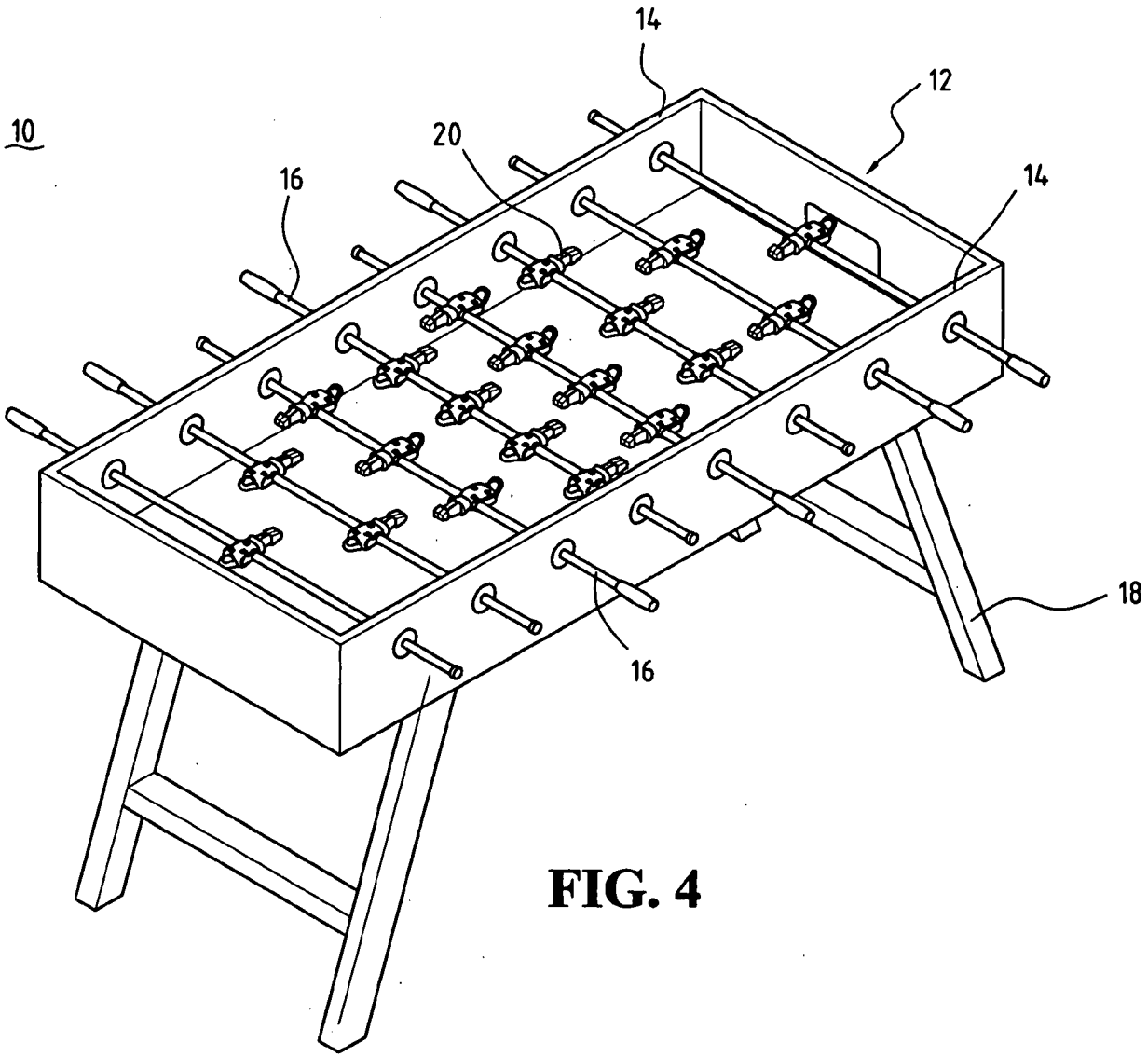
FIG. 4 is a perspective view of a soccer table in which playing figures constructed in accordance with the present invention are mounted.
Figure 5:
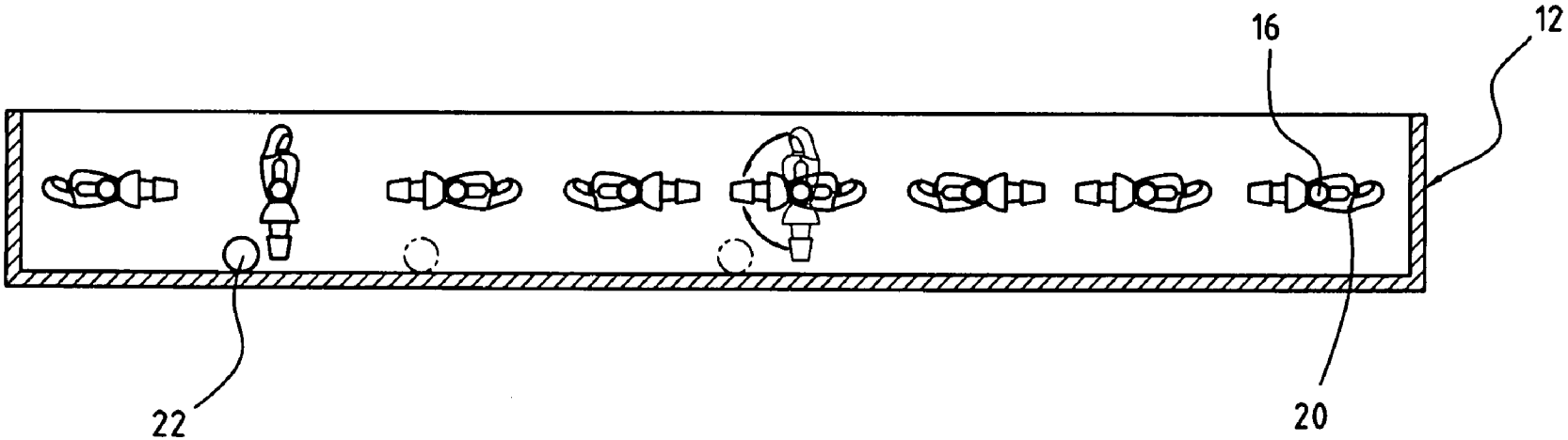
FIG. 5 is a cross-sectional view of the soccer table of FIG. 4 with legs of the table removed for simplicity.

With reference to the drawings and in particular to FIGS. 4 and 5, a table soccer 10 comprises a table 12 having opposite, spaced and parallel side walls 14 and actuating rods 16 rotatably and axially movably extending between the walls 14. Legs 18 are arranged below the table 12 for supporting the table 12 on a fixture (not shown). Playing figures 20 are mounted on the rods 16 and are axially movable and rotatable in unison with the actuating rod 16 for hitting, blocking and otherwise controlling a ball 22 (see FIG. 5).

Figure 3:
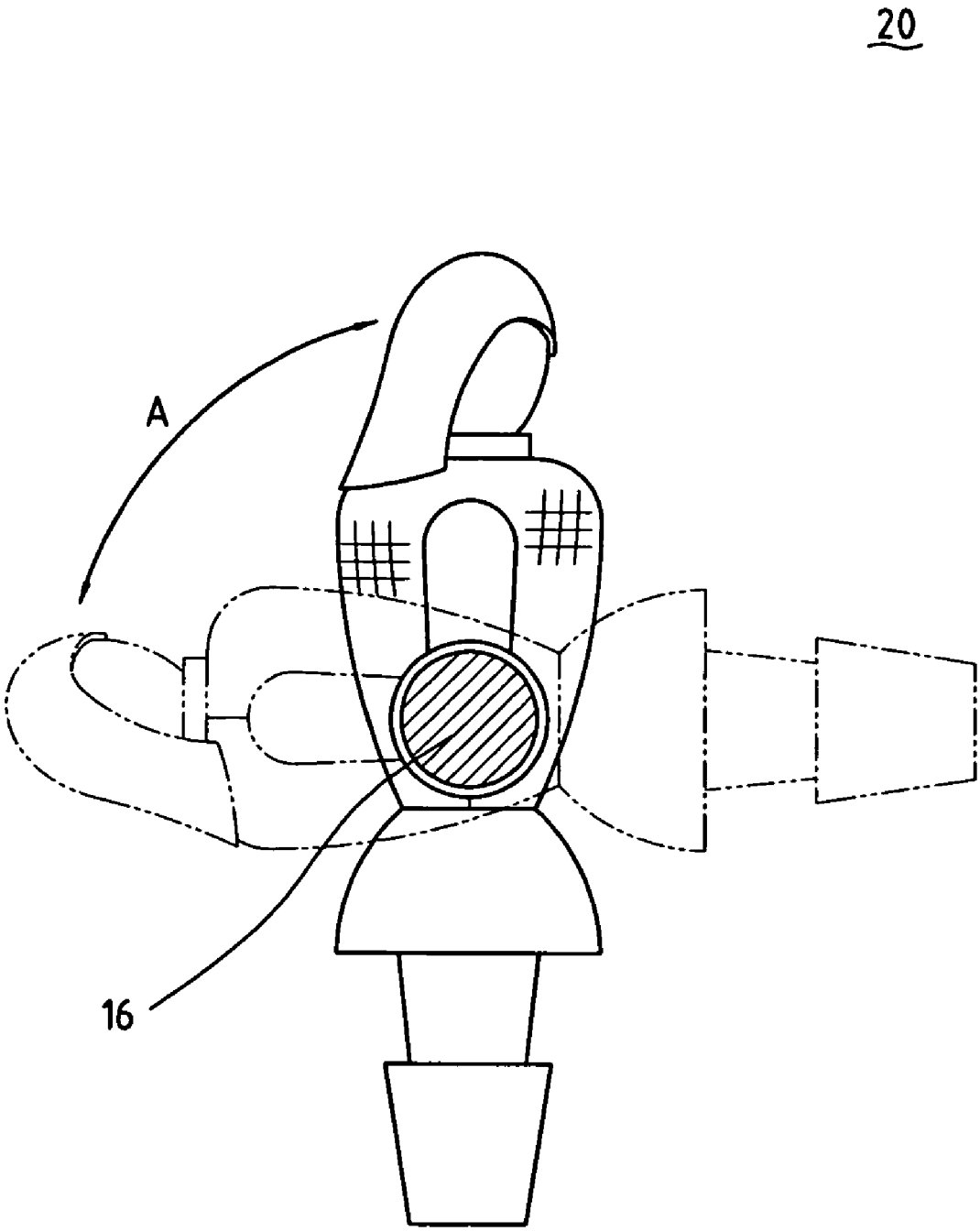
FIG. 3 is a side elevational view showing two possible postures of the playing figure.

In order to drive the ball 22 toward an opponent's goal zone, a player must hit the ball 22 with one of the figures 20 in a vertical posture, while keeping the remaining figures 20 in a horizontal posture, as illustrated in FIG. 5. Thus, the figures 20 must be rotatable between the vertical posture and the horizontal posture. This is also shown in FIG. 3 wherein the vertical posture is shown in solid lines, while the horizontal posture with phantom lines. Double arrow A of FIG. 3 indicates the rotation of the figure 20 between the two postures by being driven through the actuating rod 16.

Figure 1:
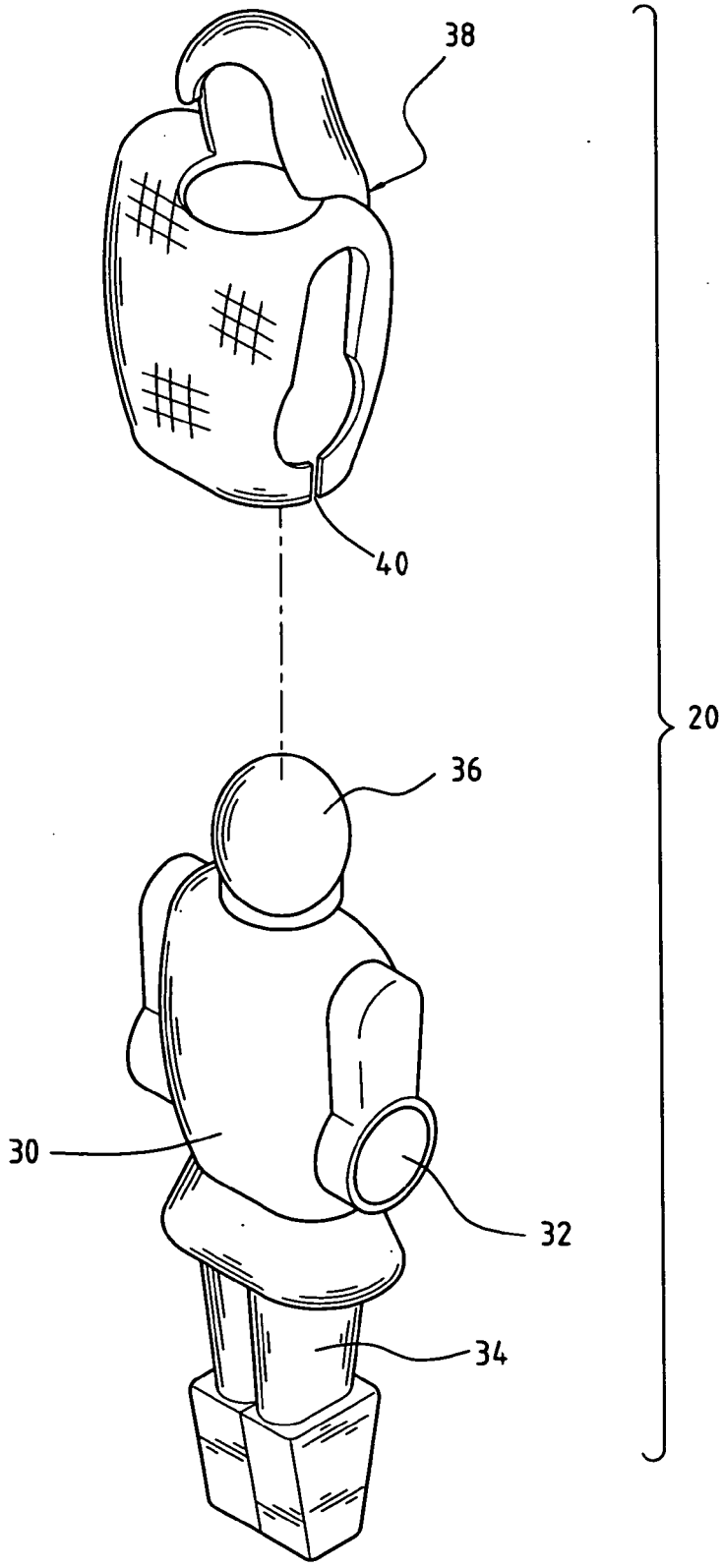
FIG. 1 is a perspective view of a table soccer playing figure with a counterweight in the form of a jacket in accordance with the present invention removed from the figure.
Figure 2:
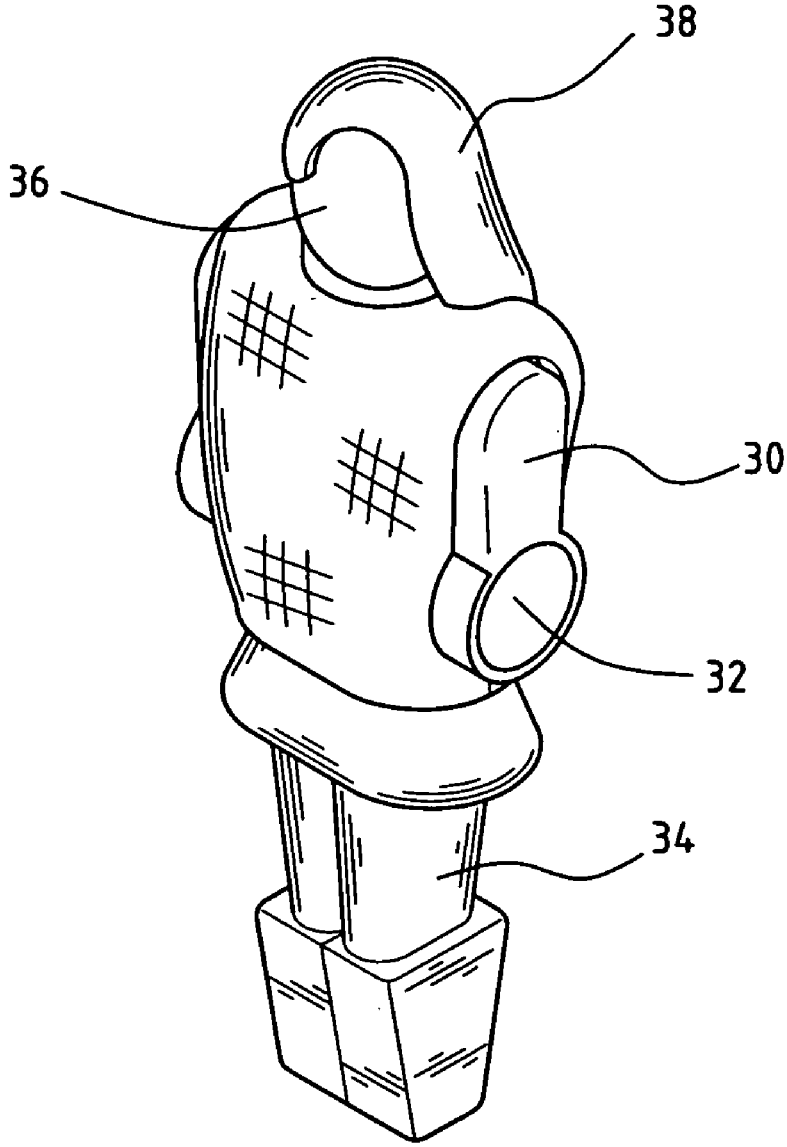
FIG. 2 is similar to FIG. 1, but with the counterweight jacket fitted on the figure.

Referring now to FIGS. 1 and 2, a playing figure constructed in accordance with the present invention, also designated with reference numeral 20 for simplicity, comprises a body portion 30 defining a transversely extending through hole 32 through which the actuating rod extends in a tight fitting manner or otherwise fixed to the body portion 30. A leg portion 34 and a head portion 36 are formed on opposite sides of the body portion 30 with respect to the actuating rod 36 (or the through hole 32).

The body portion 30, the leg portion 34 and the head portion 36 are integrally formed and are configured to have a center of gravity located in the leg portion 34 or a lower section of the body portion 30 that is on the same side as the leg portion 34 with respect to the through hole 32. Thus, when the figure 20 is mounted on the actuating rod 16, the figure 20 takes the vertical posture under the action of the gravity, as illustrated in solid lines of FIG. 3.

A jacket 38 is selectively fitted over the head portion 36 and an upper section of the body portion 30 that is located on the same side as the head portion 36 with respect to the through hole 32. The jacket 38 may be designed for decoration purposes only. In this respect, the jacket 38 is made lightweight in order not to significantly change the center of gravity of the figure 20 and thus maintaining the original posture of the figure 20.

However, in accordance with the present invention, the jacket 38 is made of substantial weight whereby the jacket 38 serves as a counterweight for balance of the gravity of the figure 20 itself. In this respect, the weight of the jacket 38 can be made arbitrary and the figure 20 is thus tilted at an angle determined by the ratio between the weights of the figure 20 and the jacket 38. In the preferred embodiment of the present invention, the weight of the jacket 38 is made substantially the same as that of the figure 20, making the center of gravity of the figure and the jacket together substantially coincident with the through hole 32 (or the actuating rod 16) whereby the figure 20 takes a horizontal posture as illustrated in phantom lines of FIG. 3.

The jacket 38 is formed with slits 40 that make lower portions of the jacket 38 resilient to help fitting onto the figure 20 in a tight but removable manner. Thus, a table soccer player may selectively mount the jacket 38 to the figure 20 to play the figures in either vertical or horizontal postures.

Apparently, the counterweight that is made in the form of a jacket in the preferred embodiment can be made in different forms other than the jacket as illustrated. For example, the figure itself may be made in a horizontal posture, while a skirt that is of substantial weight is removably attached to a lower portion of the figure to selectively convert the horizontal posture into a vertical posture. It should be pointed out that an important aspect of the invention is that the counterweight not only can be easily put on or taken off the figure but also can withstand quick pivoting movement without being slipped off during the game. To achieve this, the counterweight must have a resilient portion with at least one slit formed on a side as in the form of the jacket 38 illustrated in FIG. 1.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A playing figure adapted to mount to an actuating rod of a table soccer comprising:

first and second portions together having a first center of gravity located in the fist portion so that the playing figure takes a first posture under the action of the gravity; and a counterweight removably attached to one of the first and second portions to change the first center of gravity to a second center of gravity whereby the playing figure takes a second posture, different from the first posture, under the action of the gravity;

wherein the counterweight has a resilient portion with a hollow interior and at least one slit formed on a side so as to be tightly but removably fitted on one of the first and second portions of the playing figure.

2. The playing figure as claimed in claim 1, wherein the first portion is the leg portion of the playing figure and the first posture is a vertical posture.

3. The playing figure as claimed in claim 2, wherein the second center of gravity is substantially coincident with the actuating rod and the second posture is a horizontal posture.

4. The playing figure as claimed in claim 1, wherein the counterweight is made in the form of a jacket removably fitted over the second portion of the figure.

5. The playing figure as claimed in claim 4, wherein the jacket defines slits to provide resiliency for tightly fitting over the second portion of the figure.

* * * * *